US005954056A

United States Patent [19]

Eckman

[11] Patent Number: 5,954,056

[45] Date of Patent: Sep. 21, 1999

[54] BACK INJURY RECOVERY METHOD

[76] Inventor: Walter W. Eckman, 408 Council Cir., Tupelo, Miss. 38803

[21] Appl. No.: 08/876,975

[22] Filed: Jun. 16, 1997

Related U.S. Application Data

[63] Continuation of application No. 08/448,910, May 24, 1995, abandoned.

[51] Int. Cl.[6] ..... A61B 19/00

[52] U.S. Cl. ..... 128/898

[58] Field of Search ..... 128/897–98

[56] References Cited

U.S. PATENT DOCUMENTS

| | | |
|---|---|---|
| 4,750,741 | 6/1988 | Smolanovich . |
| 5,037,085 | 8/1991 | Wexler . |
| 5,067,709 | 11/1991 | Christianson . |
| 5,108,090 | 4/1992 | Reed . |
| 5,147,267 | 9/1992 | Kunewalder . |
| 5,217,487 | 6/1993 | Engel et al. . |

OTHER PUBLICATIONS

Stretching in the Rehabilitation of Low–Back Pain Patients, Khalil et al., Spine vol. 17, No. 3, Mar., 1992. pp. 311–317.

The Intensity of Work Recovery in Low Back Pain, Andersson et al., Spine vol. 8, No. 8, 1983. pp. 880–884.

A New Clinical Model for the Treatment of Low–Back Pain, Waddell, Spine vol. 12, No 7, 1987. pp. 632–644.

A Rational Approach to the Treatment of Low Back Pain, Nelson, from The Journal of Musculoskeletal Medicine, May 1993. pp. 67–82.

Muscle, Pollock et al., from Rehabilitation of the Spine, ch. 22, 1993. pp. 263–284.

Changes in Isometric Strength and Range of Motion of the Isolated Cervical Spine After Eight Weeks of Clinical Rehabilitation, Highland et al., Spine, vol. 17, No. 6S, Jun. 1992. pp. S77–S82.

Lumbar Strengthening in Chronic Low Back Pain, Risch et al., Spine, vol. 18, No. 2. 1993. pp. 232–238.

Changes in Isometric Strength and Range of Motion of the Isolated Lumbar Spine Following Eight Weeks of Clinical Rehabilitation, Russel et al., presented at the North American Spine Society Annual Meeting, 1990.

Effect of Reduced Frequency of Training and Detraining on Lumbar Extension Strength, Tucci et al., Spine, vol. 17, No. 12, Dec. 1992. pp. 1497–1501.

Strength Testing Can Identify Malingering, Mooney et al., from The Journal of Workers Compensation, vol. 2, No. 1, 1992. pp. 55–64.

Quantitative Assessment of Full Range–of–Motion Isometric Lumbar Extension Strength, Graves et al., Spine, vol. 15, No. 4, Apr. 1990. pp. 289–294.

Effect of Training Frequency and Specificity on Specificity on Isometric Lumbar Extension Strength., Graves et al., Spine, vol. 15, No. 6, Jun. 1990. pp. 504–509.

Effect of 12 and 20 Weeks of Resistance Training Lumbar Extension Torque Production, Carpenter et al., from Physical Therapy, vol. 71, No. 8, Aug. 1991. pp. 580–588.

*Primary Examiner*—John P. Lacyk
*Attorney, Agent, or Firm*—Allen, Dyer, Doppelt, Milbrath & Gilchrist, P.A.

[57] ABSTRACT

The early care of low-back pain using a series of stretching exercises that include knee to chest stretching, straight leg rising stretching, sitting toe touches and lumbar flexion stretching aid the gradual healing of low-back pain without the need for medical treatment. With such stretching, sufficient ability to bend the body in flexion is achieved. Further, the strengthening of the lumbar muscles with graded weight lifting continues a path to recovery and control over what would otherwise be immobilizing low-back pain.

28 Claims, 4 Drawing Sheets

Waddell, G. Spine: 12:632:1987
Andersson et al. Spine: 08:880:1983

BACK INJURY RECOVERY METHOD

This is a continuation of pending application Ser. No. 08/448,910 filed May 24, 1995, now abandoned.

BACKGROUND OF INVENTION

1. Field of Invention

The present invention relates to the treatment of low back pain through a structured exercise protocol, and in particular to on-site early care methods employing stretching and graded weight lifting for minimizing the role of surgery in treatment of low-back pain and maximizing the benefits of natural recovery of the injured back.

2. Background Discussion

The management of degenerative diseases of the spine, particularly low-back pain, represents a major challenge in the development of efficient and cost-effective healthcare systems for the future. Low-back pain is the most common medical condition in the Western World and affects about eighty per cent of the population within their lifetime. At any given time, it is estimated that over thirty million Americans are affected. In particular, there is an increasing incidence of low-back pain affecting the working industrial population and it is a major cause of industrial disability. Second only to the common cold, low-back pain results in more time lost from work than other illnesses. An average of 1.4 lost days per worker per year has been estimated. Further, chronic back problems are the number one cause for disability below the age of 45 and the third major cause over the age of 45. Back problems commonly affect the work population and have made and continue to make a profound impact on our society including financial impacts amounting to billions of dollars annually. Thousands of workers are on the payroll, but not on the job as a result of low back injuries and disabilities. Extensive bed rest, medication and even surgery are typically offered as methods for recovery form such back pain.

In an article of *SPINE*, Vol. 12, No. 7, 1987, titled "A New Clinical Model for the Treatment of Low-Back Pain" by Gordon Waddell, the author concluded with a statement that modern medicine can successfully treat many serious spinal diseases and persisting nerve compression but has completely failed to cure the vast majority of patients with simple low-back pain. Further, the author further stated that bed rest is unanimously taught in all standard textbooks as the first line of treatment for acute attacks, yet it is difficult to discover when or why bed rest became the conservative accepted treatment.

Stretching exercises are well known to provide beneficial effects. Many books and articles have been written addressing the variety of stretching exercises and the need to stretch before the physical activities of racquetball, tennis, jogging, cycling and the many sports including walking that the world has come to enjoy. By way of example, "Stretching" by Bob Anderson, published by Shelter Publications, Inc. in 1980 promotes stretching as a part of daily life and recommends a series of stretching exercises for various parts of the body including the lower back. Each exercise has a recommended technique and position. Each will stretch the muscles to which the exercise is directed, but none provide the precise steps to follow when addressing the recovery of the pain of low back injury.

Further, various devices have been proposed to aid the strengthening and stretching process of the lower back. By way of example, a back stretching chair of U.S. Pat. No. 4,750,741 to Smolanovich provides a back rest rotatably coupled to a base for stretching the back during movement of the seat. U.S. Pat. No. 5,037,085 to Wexler discloses a device and method for lumbar-thoracic stretching which comprises a pair of parallel plates interconnected by a post assembly used by a person lying on his side with an uppermost knee wrapped around the post assembly and the thighs between the two plates. With thighs and legs fixed relative to each other, the upper torso is twisted thereby stretching the lumbar and thoracic spines. U.S. Pat. No. 5,067,709 to Christianson discloses a device for stretching and strengthening the muscles of the lower back and legs of a person in a supine position. The device includes a board with straps to restrain the pelvis of the person and a rope and pulley assembly for raising the legs. The back exercising device of U.S. Pat. No. 5,108,090 to Reed includes a leg immobilizing unit to which is attached a reciprocating unit for expanding and contracting the paraspinal and leg muscles of the user. U.S. Pat. No. 5,122,106 to Atwood et al. discloses yet another stretching apparatus. The apparatus disclosed includes a base structure for supporting an individual in a supine position and a cradle within which a leg is positioned. A stretching load is applied to the leg by arm assemblies of the cradle for stretching the muscles of the lower back and legs.

Although many devices are provided in the art, none seem to be simpler for exercise than putting our bodies through various exercise routines without the need for such devices. With a proper protocol, stretching and simple strengthening exercises would be beneficial for recovery from back pain. The present invention seeks to provide that proper protocol which heretofore has not been provided.

SUMMARY OF THE INVENTION

A series of stretching and weight lifting exercises are disclosed for a person desiring to recover from low-back pain. Through a series of exercises, flexibility of the lumbar spine in flexion is achieved. Once the person has regained sufficient ability to bend their body in flexion, graded weight lifting exercises are performed for strengthening the lumbar extensor muscles.

It is a primary object of the invention to provide a series of exercises for restoring full motion in flexion that are performed by the injured person without the need for expensive or complicated exercise equipment. It is yet another object of the invention to provide a means for strengthening extensor muscles of the spine so that the person recovering from the low back injury can come from a forward bent position to an upright position without major limitation, even while lifting weights.

It is an object of the present invention to provide a method for a person to recover from a low-back injury with minimal loss of time away from normal daily duties, and in the case of an employee, without loss of valuable work time. It is further an object of the present invention to provide a method for recovering from an injury that results in low-back pain by only temporarily altering work assignments or physical activity while restoring motion and flexibility of the lumbar spine. The steps of the present invention restore motion of the lumbar spine in flexion so that bending forward is accomplished.

To meet the objects of the invention, a method for restoring motion of the lumbar spine in flexion is provided which includes the steps of standing in an upright position on a surface with both legs straightened at the knees and arms hanging naturally at the sides, bending forward at the waist while keeping knees straight, continuing the bending step to a flexed position wherein the arms are extended with hands reaching toward the toes, and maintaining this flexed position for a predetermined time period, usually from five to ten seconds in a preferred method. After holding the flexed position, slowly rise to the standing position, and continue by repeating the bending, maintaining and rising steps for realizing a restored motion of the lumbar spine in flexion.

The method further comprises the steps of repeated flexion of the body at the waist while attempting to keep the legs straight and while holding a weight in the hands. The method includes stepping forward with one foot while in the standing position, bending both knees and leaning forward in a crouched position in order to grasp a weight, grasping a weight which is lying on the surface within reach of the hands, and rolling the weight proximate the body to a position above the feet. The weight is then lifted while tightening abdominal muscles and rising to the forward stepping position. From this position, move to the standing position with feet generally parallel and separated by a shoulders width. Holding the weight below the waist in front of the legs, u proceed by again bending forward at the waist while keeping knees straight and continue flexing at the waist by bending while holding the weight. Then rise to the standing position. In a following sequence, you repeat the waist bending and rising steps while holding the weight.

In a preferred embodiment of the method, you grasp the weight, typically provided in the form of a bar, with palms down and hands separated by approximately a body width. Further, return the weight to the surface by stepping forward with one foot while holding the weight and bending at the knees to the crouched position for lowering the weight onto the surface. Place the weight onto the surface and release it. Then shifting your body weight over the feet, rise to the standing position using leg muscles. The method steps are followed by resting in the standing position.

If an increased weight can be tolerated by the lower back pain, the method steps continue with the steps of increasing the weight for maneuvering the weight during the bending and rising steps and repeating the bending and rising steps while holding the increased weight. After increasing the weight, it may be necessary to make adjustments, in which case the method steps include reducing the weight based on the tolerance level for maneuvering the weight during the bending and rising steps. The bending and rising steps are then carried out while holding the reduced weight until the steps can be tolerated using added weight.

After the initial onset of low-back pain, it may not be possible to exercise while standing. If this is the case, flexing while lying or sitting on the surface is carried out until standing is possible within the pain tolerance level.

In the present invention, one method of flexing prior to the standing and subsequent steps includes lying supine on the surface with legs bent in slight flexion at the knees, pulling a first leg to a sufficiently close position proximate the chest while continuing to bend the corresponding first knee, the sufficiently close position determined by a tolerable lower back flexion pain level, maintaining the first leg in the pulled position with its knee fully bent, lowering the first leg to the surface while straightening the first knee, and returning the first leg to its slight flexion position. These steps are then followed by pulling a second leg to the sufficiently close position proximate the chest while continuing to bend the corresponding second knee, maintaining the second leg in the pulled position with the corresponding second knee fully bent, lowering the second leg to the surface while straightening the second knee, and returning the second leg to its slight flexion position. Tolerance to pain is monitored and the pulling, maintaining, lowering, and returning steps are repeated for the first and second legs while in the supine position until the tolerable pain level permits the upright standing step.

Another flexing method prior to the standing and subsequent steps includes lying supine on the surface with both legs bent in slight flexion at the knees, straightening the first leg, elevating the first leg by flexing at the hip, lowering the first leg to the surface, and returning the first leg to the slight flexion position. This is followed by straightening the second leg, elevating the second leg by flexing at the hip, lowering the second leg to the surface, and returning the second leg to the slight flexion position. The pain tolerance level is monitored. Further, the straightening, elevating, lowering, and returning steps are repeated for both legs while in the supine position until the tolerable pain level permits the upright standing step.

In the present invention method, yet another set of flexing steps is provided prior to the standing step in preparation of the standing and subsequent steps. These flexing steps include sitting on the surface with body generally upright and fully extending legs in a generally straight position, bending forward at the waist to a position of maximal stretch, the arms extending straight toward the toes while keeping the legs in the straight position, maintaining the forward bending position for a predetermined period of time, and slowly returning to the upright sitting position. These bending, maintaining and returning steps are repeated while in the sitting position until the tolerable pain level permits the upright standing step.

BRIEF DESCRIPTION OF DRAWINGS

The preferred embodiment of the inventive steps are described by way of example with reference to the accompanying drawings in which.

DETAILED DESCRIPTION OF PREFERRED EMBODIMENT

The preferred embodiment of the present invention is a method for restoring a person's flexibility of the lumbar spine, and specifically for restoring such flexibility after injury resulting in low-back pain. By way of example, the methods of the present invention address the on-site recovery from low-back pain for those wishing to return to work with minimal loss of time. It is important to accept the principle that low-back pain abates by gradual, natural healing; and although there may be times when medical treatment is necessary, it is not a requirement that medical treatment be performed. In essence, low-back pain cannot stop an employee from returning to a job that he or she enjoys; and an employee with low-back pain does not have to recover away from the work place. Work assignments and physical activity must be temporarily altered to accommodate those with low-back pain. With the method of the present invention, an employee with low-back pain is given a path to recovery and, if so motivated, can return to work while taking the steps to recover from such low-back pain. It is understood that the severity of low-back pain will differ from person to person and that the recovery time will also vary. The present invention provides a series of exercises to restore full motion in flexion and strengthen extensor muscles for that person having low-back pain.

Figure 3:
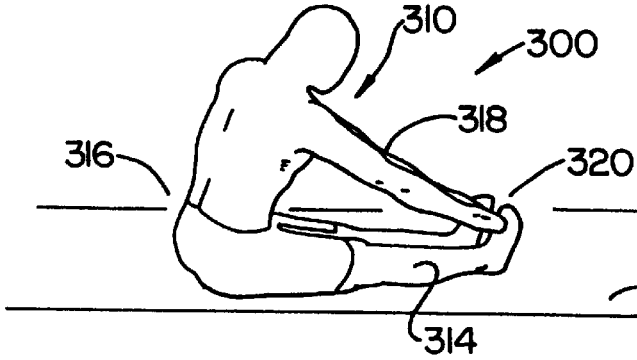
FIG. 3 illustrates a sitting toe touch stretch exercise.
Figure 4:
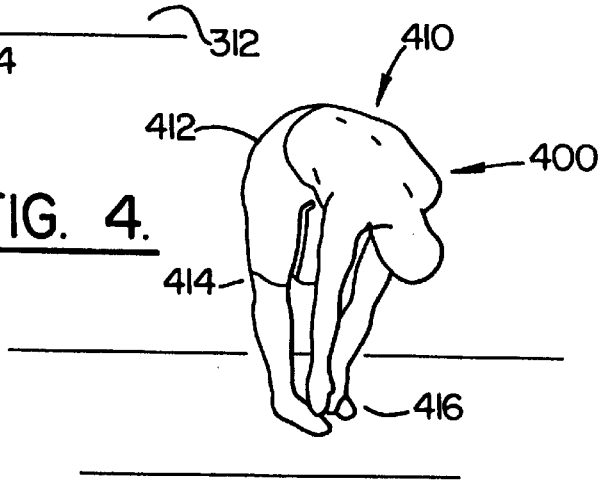
FIG. 4 illustrates a position in a lumbar flexion stretch.
Figure 4A:
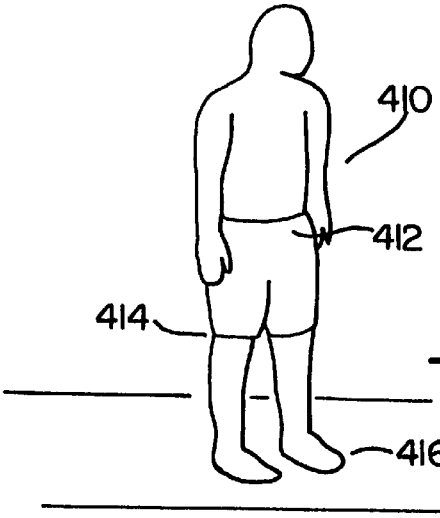
FIG. 4*a* illustrates a preparatory position for the lumbar flexion stretch exercise of FIG. 3.

As was earlier described, a primary object of the present invention is to provide full motion of the lumbar spine and further to strengthen extensor muscles of the spine. Full motion and strength exercises are herein described with reference to FIGS. 1–11. In the preferred embodiment, it is an ultimate goal to achieve flexing at the waist while starting from a standing position, as illustrated in FIGS. 4 and 4*a*, and having the ability to perform graded weight-lifting exercises, as will be herein described with reference to FIGS. 5–11. Before performing such exercises from the standing position, it may be necessary to first perform a series of flexing exercises while lying or seated. The description steps through such a series of exercises leading to those exercises will ultimately provide full motion and extensor muscle strengthening.

Figure 1:
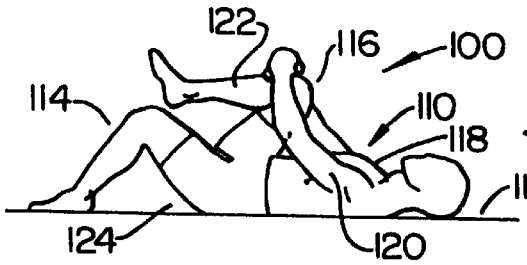
FIG. 1 illustrates a person positioned for a single knee-to-chest stretch exercise.
Figure 2:
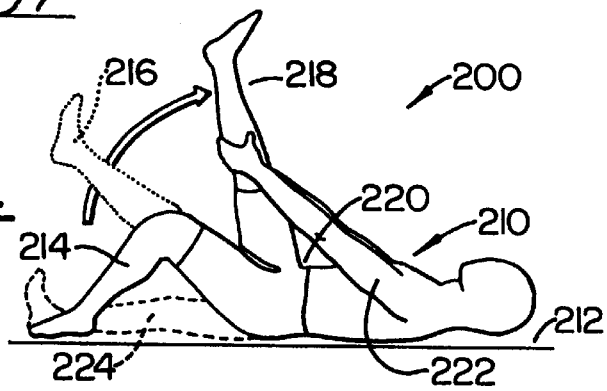
FIG. 2 illustrates a person positioned for a straight leg raise/hamstring stretch exercise.

In the early stages of recovery, the injured person is taken through a series of stretching exercises to have that person regain sufficient ability to bend his body forward in flexion, especially if standing is not possible because of sever low-back pain. With reference to FIGS. 1–3, three specific exercises for restoring a person's flexibility of the lumbar spine are presented and respectively referred to in this description as a single knee-to-chest stretch 100, straight leg raise/hamstring stretch 200, and a sitting toe touch 300.

With specific reference to FIG. 1, the single knee-to-chest stretch 100 provides that a person 110 lie supine on a comfortable surface 112 with both knees bent in slight flexion 114. Once in such a position, one knee 116 is brought closer to the chest 118 and is slowly pulled toward the chest with the arms 120 while keeping the flexing leg 122 flexed at the knee 116. In one embodiment of the present inventive method, this single knee-to-chest stretch position 100 is held for five to ten seconds. The bent leg 122 is then slowly extended and lowered to the surface 112 at body level 124. This leg 122 is then returned to its original bent knee position 114, as illustrated with reference to the second leg of FIG. 1. The single knee-to-chest stretch 100, in the present method, is repeated a preferred four to five times while performing such steps for alternate legs.

The straight leg raise/hamstring stretch 200, as illustrated with reference to FIG. 2, provides that the person 210 lie on comfortable surface 212 with both knees bent in slight flexion 214 as was earlier described with reference to the single knee-to-chest stretch 100. One leg 216 is straightened and brought to an elevated position 218 by flexing at the hip 220. The arms 222 are used to help bring the leg to the elevated position 218 as much as possible based on the level of pain being felt by the injured person 210. It is preferred that this straight leg raise/hamstring stretch position 200 be held for five to ten seconds. Once stretching through such steps, the leg is brought from the elevated position 218 to a body level position 224 on the surface 212. The leg is then brought from the body level position 224 to the original bent knee position 214, as illustrated with reference to FIG. 2, for the alternate leg. The straight leg raise/hamstring stretch 200 is repeated from four to five times and for alternate legs.

In the early stage of back injury, the injured person performs the single knee-to-chest stretch 100 and straight leg raise/hamstring stretch 200 exercises until he can stand or bend forward fairly well while tolerating the lower back pain. Once this is possible, the sitting toe touch stretch 300 and the lumbar flexion stretch 400 exercises are attempted and, if within pain tolerance level, performed.

The sitting toe touch stretch 300 requires that the person 310 sit on a comfortable level surface 312 with both legs 314 fully extended or straight. The person 310 bends forward at the waist 316 with both arms 318 extended straight in an attempt to touch the toes 320 (or to a maximal stretch position) while keeping the legs straight, as illustrated again with reference to FIG. 3. Even without touching the toes 320, the sitting toe touch stretch position 300 is held for five to ten seconds, after which time the body is relaxed. The sitting toe touch stretch 300 is repeated four to five times, each time trying to stretch closer to the toe touch position.

Once it is possible to stand while tolerating the existing low-back pain, exercises starting at the standing position are performed. The lumbar flexion-stretch 300 provides that the person 410 stand with the body straight and the feet just slightly apart for adequate balance, as illustrated with reference to FIG. 4*a*. The person 410 then bends forward at the waist 412 while trying to keep the knees 414 straight. The person 410 slowly reaches towards the knees 414 and gradually toward the toes 416. Depending on the level of pain and the degree of flexion, bending with hands reaching to the toes 416 may not be immediately possible. The lumbar flexion-stretch 400 is repeated from 10 to 15 times with an effort to reach a little lower and closer to the toe stretch position 416. At each attempt to reach lower, the lumbar flexion-stretch 400 is held for about two to three seconds.

Once the person has regained sufficient ability to bend the body forward in flexion, it is time to strengthen the lumbar extensor muscles with further stretching and graded weight-lifting exercises. Depending on the person and the degree of low-back injury, various levels of pain will exist. However, it is the ability to bend the body in flexion while tolerating such pain that provides for the lumbar extensor muscles strengthening steps.

As is well known in the medical art, bending forward at the waist, we are flexing major motion structures, including the hip and the lumbar spine. This involves motion of the soft tissues, muscles, tendons and ligaments that are involved with the hip and potentially the pelvis. However, the pelvis doesn't move very much. Basically the hip joint, hamstring muscles, which attach all the way down to the posterior part of the knees, the gluteus muscles (particularly gluteus maximus which is the large buttocks muscle) and lumbar extensor muscles, plus associated soft tissues in the lumbar spine are worked. The lumbar spine includes a variety of different kinds of muscle groups that extend from the pelvic crest or hip area up to the area of the ribcage and to the spine elements. It includes several motion segments.

Below dorsal vertebrae T12, each disk space level corresponding to a motion segment. These include T12-L1, L1-L2, L2-L3. L3-L4, L4-L5 and L5-S1, a total of six motion segments, L1 to L5 being the lumbar vertebrae and S1 the upper sacrum (not shown). Each motion segment consists of a moveable disk and its surrounding ligaments, with vertebral body above and below. Two facet joints, one on each side are in the posterior part of the spine and the elements, including joint capsules and ligaments that hold the joints together. Further, the muscles muscles and soft tissues would be additional elements that take part in this motion. As we bend at the waist, we flex these elements. As we come back up to a standing position, we strengthen the muscles within this group, and possibly the tendons and ligaments.

The strengthening of lumbar extensor muscles, using graded weight lifting. consists of repetitive flexion of the body at the waist while attempting to keep the legs straight as will be described in detail with reference to FIGS. 5–11. In the preferred embodiment, a standard weight bar is held in front of the legs with the hands positioned with palms facing towards the legs. The amount of weight on the bar is gradually increased with time and the range of motion is also incrementally increased. It is recommended that the earlier described lumbar flexion-stretch 400 or the sitting toe touch stretch 300 be performed as described before each attempt to work with graded weight lifting. As will be described herein detailed, the person should begin the graded weight-lifting procedure with an empty weight bar and, in the preferred embodiment of the method, typically ten pounds in weight.

Figure 5:
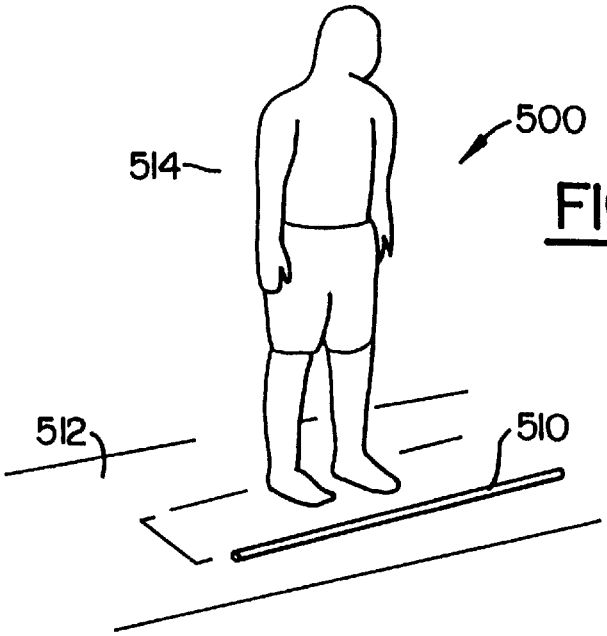
FIG. 5 illustrates an initial position for preparation of strengthening lumbar extensor muscles with graded weight lifting.
Figure 6:
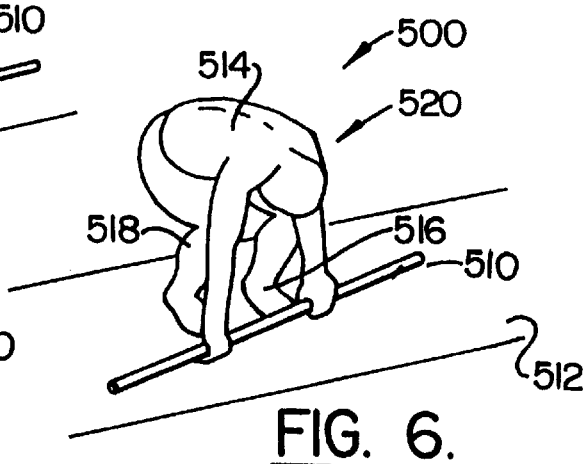
FIG. 6 illustrates a crouched position of the grading weight lifting.
Figure 7:
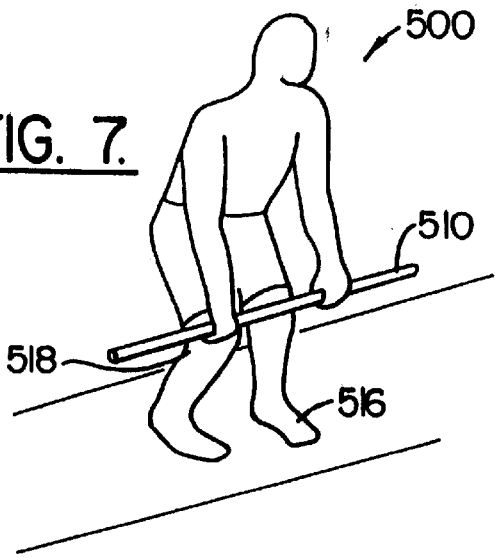
FIG. 7 illustrates an intermediate position in lifting.

Graded weight lifting exercises 500 are illustrated in detail with reference to FIGS. 5–11. With reference to FIG. 5, a weight bar 510 is placed on the floor 512 while the person 514 stands approximately one and a half feet away from the bar 510 while facing the bar 510. As illustrated with reference to FIG. 6. the person 514 steps forward with one foot 516. While bending at the knees 518 and leaning forward in a half-crouched position 520, grasps the bar 510 with the palms of the hand down and the hands apart approximately the width of the body. The bar 510 is rolled close to the body and to a position just above the forward foot 516. While tightening the abdominal muscles, the bar 510 is lifted, as illustrated with reference to FIG. 7, and the body brought to a standing position 522, as illustrated with reference to FIG. 8. Also with reference to FIG. 8, the back foot 524 is brought forward to a position 526 such that the feet are centered just behind the bar, generally parallel to each other and at a distance approximately equal to shoulder width.

Figure 8:
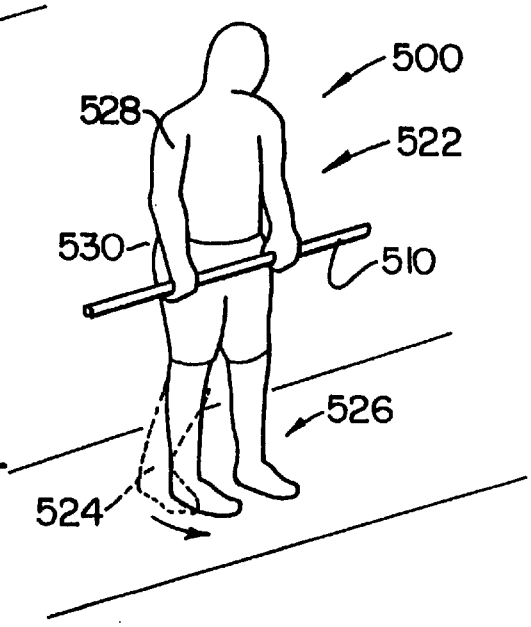
FIG. 8 illustrates a standing position in lifting.

The bar 510 is held with the arms 528 in a generally relaxed state such that the bar 510 rests close to the body below the waist 530 when in the upright standing position 522, as again illustrated with reference to FIG. 8.

Figure 9:
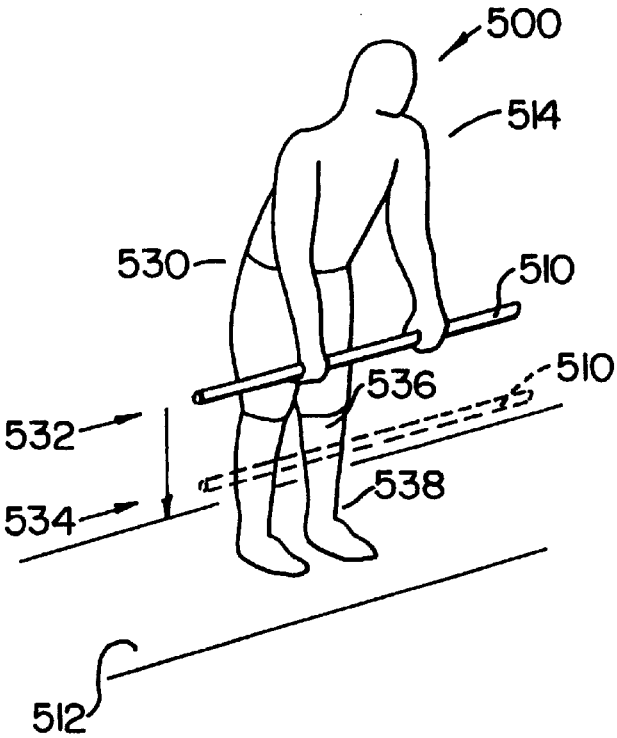
FIGS. 9 and 10 illustrate alternate bending positions in the graded weight lifting steps.
Figure 10:
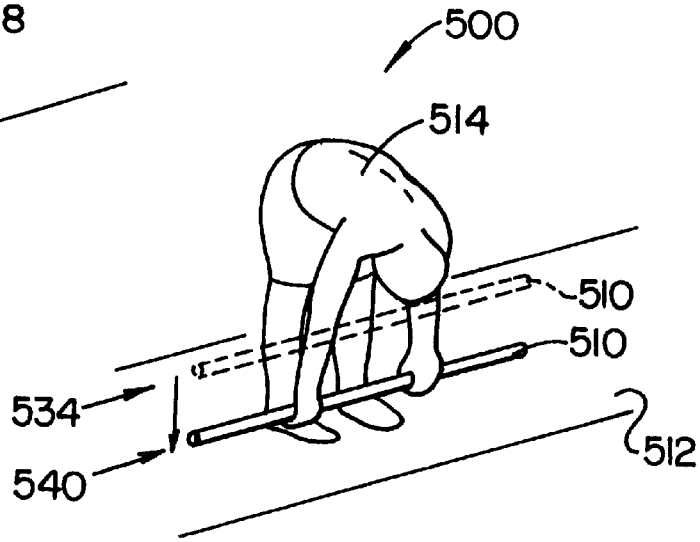
Figure 11:
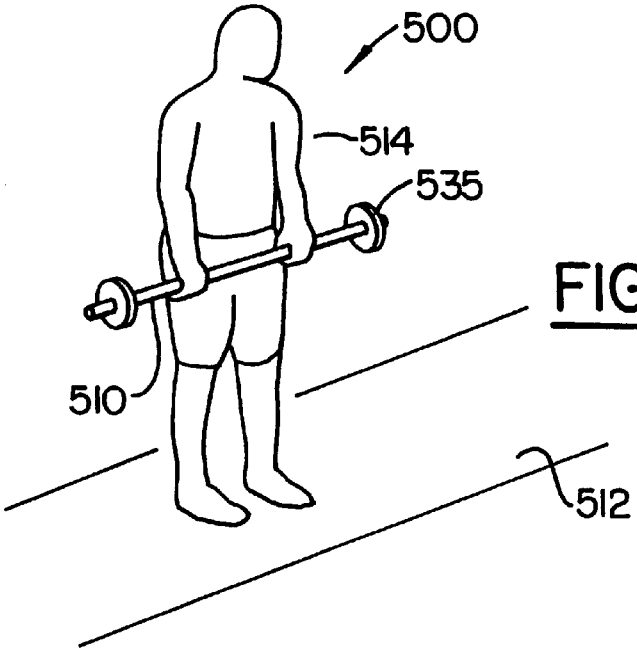
FIG. 11 illustrates the use of additional weights in the strengthening lumbar extensor muscle exercise with graded weight lifting.

With the abdominal muscles tightened to help stabilize the body, the exercise 500 for strengthening the lumbar extensor muscles while using graded weight lifting is carried out by repetitively bending forward in flexion, as illustrated with reference to FIGS. 9 and 10, and returning to the upright position 522, as illustrated with reference to FIG. 8. In the preferred embodiment of the present method steps, each series of bending motions involves approximately 20 repetitions using a specific set of weights and reaching a specific level of flexion corresponding to various positions along the legs, as will be further detailed herein. By way of example, after 20 repetitions, the person 514 steps forward with one foot 516 and bends at the knees 518 to the crouched position 520 and lowers the bar 510 to the floor, thus reversing the steps as earlier described with reference to FIG. 6. The bar 510 is released and, while shifting body weight to a location centered over the feet and using the leg muscles, the person 514 rises back to the upright standing position, as illustrated again with reference to FIG. 5. While in this standing position, the person 514 rests and generally relaxes for a short time in preparation for repeating the above-described procedure for another 20 repetitions.

Such procedures as described with reference to FIGS. 5–10 are carried out generally twice a day, so that a total of approximately 80 repetitions are completed each day. It is important to follow the lifting techniques herein described and, in some cases. be supervised or instructed in carrying out such precise lifting techniques to avoid problems generally associated with poor lifting techniques well known in the art. Each person will experience differences in their tolerance for this exercise 500, and the rate of progress will vary. Such progress can be further described with reference to various levels of flexing for any given exercise session.

By way of example, and with reference again to FIGS. 5–10, three such flexing or bending levels are described. During exercise 500 sessions for the first two days, the weight bar 510 alone is used. As illustrated with reference to FIG. 9, the person 514 bends forward at the waist 530 in flexion until the weight bar 510 reaches approximately knee level 532. Bending to knee level 532 during the various repetitions continues while increasing the weight of the bar 510 or weights 535 added to the bar 510. Weights 534 totalling approximately ten pounds (typically five pounds on each end of the bar 510) are added every two to three days until the total amount of added weight equals approximately 40 pounds. The exercise 500 herein described continues at this added weight level for an additional two to three days. After such time, the exercise 500 proceeds to a second level 534 where the bar is lowered to the mid-lower leg or shin, as illustrated by the dotted bar of FIGS. 9 and 10.

For this second level 534, during the first two days of the exercise 500 at this level 534, the weight bar 510 is again used without added weights. The person 514 bends forward in flexion until the weight bar 510 reaches the level 534 generally midway between the knee 536 and ankle 538. As described earlier, weights 535 are increased by ten pounds every two to three days until the added weight equals 40 pounds. The exercise 500 continues with the bending to the mid-lower leg or shin level 534 for an additional two to three days. Once this has been completed, the exercise 500 proceeds to the next level 540 including bending to the ankle 538.

Bending to the third or ankle level 540 begins with the exercise 500 by bending forward to the ankle level 534 with 10 to 20 pounds added to the weight bar 510. Weights 535 are increased by ten pounds every two to three days until the added weight equals 40 to 50 pounds. The exercise 500 with the bending to this third level 540 continues with the added weight for the repetitions as earlier described.

Once the person 514 has returned to regular functions at work, the frequency of the exercise 500 to strengthen the lumbar extensor muscles using the graded weight lifting is reduced to approximately two to three days per week. Further. rather than performing the exercise on the job as herein described by way of example, such exercises are carried out at home without any disturbance in the work day. Thus, a goal of the present invention to provide a method for restoring a person's flexibility and low-back motion is met, especially to the point where lower back pain and lower back injury can be addressed without significant or critical loss of time from work.

As earlier discussed, a pattern of back pain will vary depending on the severity of the injury and the particular person inflicted with the pain. Increased back pain can occur during the above-described method steps of gradually increasing weight during the lifting procedures. When such increased pain occurs, the added weights 535. as earlier described, are not increased as stated but in fact reduced by as much as 20 to 30 pounds for a few days. When tolerance of the pain improves, the process as earlier described continues with the gradual addition of weights and the repetitions and steps herein described.

Figure 12:
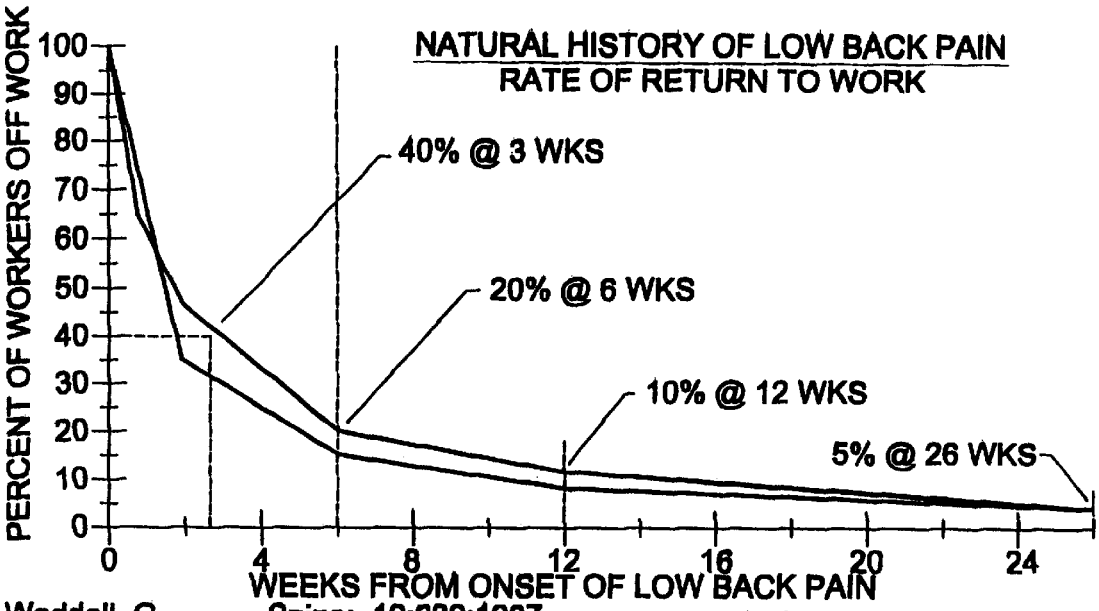
FIG. 12 is a graph illustrating the natural history of low-back pain.
Figure 13:
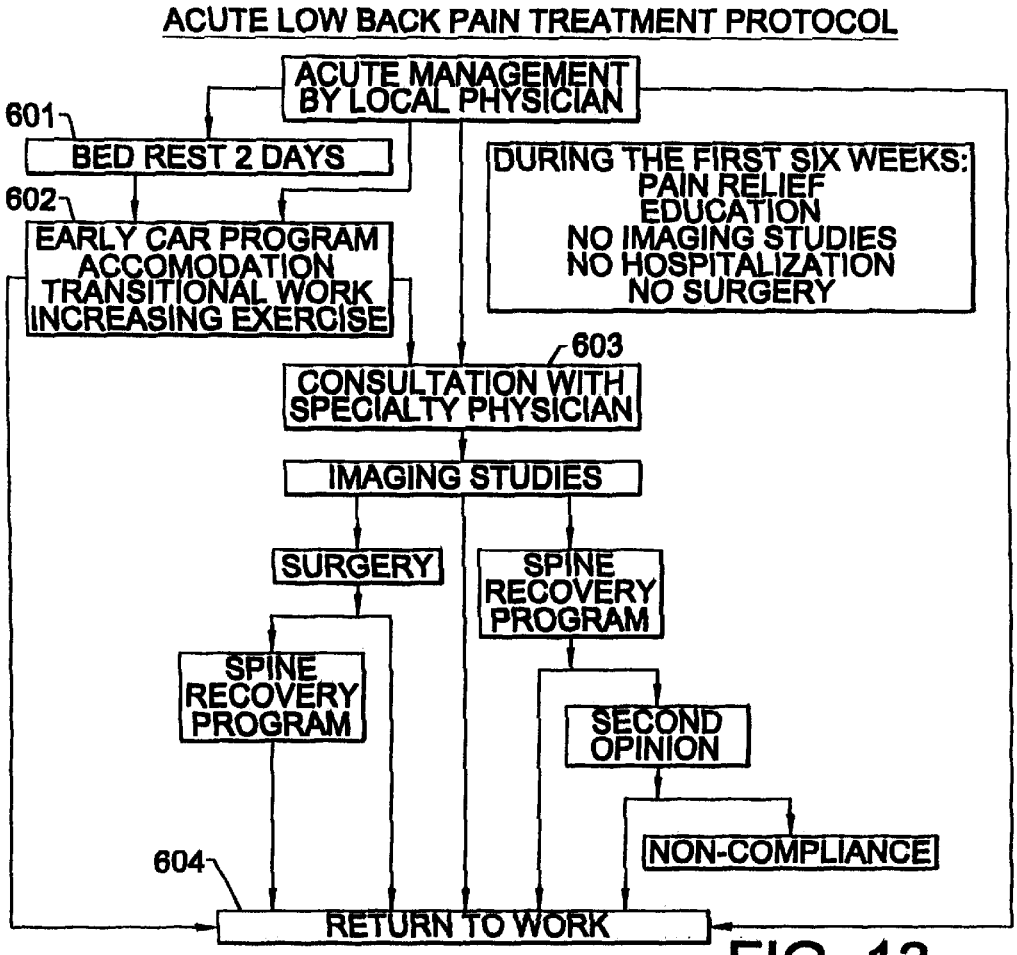
FIG. 13 is a flow chart illustrating a low-back pain treatment protocol.

As was discussed in the background section of this specification, there is an increasing incidence of low-back pain affecting the working industrial population, and it is a major cause of industrial disability. In a publication of *SPINE*, Vol. 8, No. 8, 1983, an article entitled "The Intensity of Work Recovery in Low-Back Pain" by Andersson, et al., the recovery rate in blue-collar and white-collar workers was analyzed. Results were reported for all low-back sickness, as illustrated with FIG. 12. As seen, a significantly larger percent of workers out of work because of low-back pain takes place during the first six weeks from the onset of the low-back pain. Therefore, if the inventive method of restoring a person's flexibility is performed during the early stage of low-back pain, or during this "window of opportunity" of the first six weeks, most workers can return to productive work with a minimal loss of time away from normal duties, one object of the present invention. Further, it is appreciated that an early care program, including the present invention, is not a cure-all, but in fact has a place in an acute low-back pain treatment protocol, as illustrated by reference to FIG. 13. By way of example, in the acute management by a local physician 600, bed rest 601 for a couple of days may be recommended, followed by the early care program 602 of the present invention. Alternatively, the early care program 602 may be implemented directly, or by-passed with the injured person consulting with a specialty physician, and continuing until return to regular work 604 is achieved. As described earlier, an object of the present invention includes the return to regular work 604 through the early care program 602 of the present invention, which as has been experienced, will be the case in the majority of instances. Tests have been run using the present invention for recovery from low-back pain injury with workers at various manufacturing facilities. In one example, total medical costs and total compensation costs resulted in a combined total of approximately $1500 for a given test year. For the year prior to the test, such costs exceeded $50,000. For the second year prior to the test, such costs were about $27,000. The results supported the findings that costs associated with low-back pain injuries were increasing from one year to the next, and supported the fact that implementing the method of the present invention within the first six weeks from the onset of the low-back pain resulted in a significant cost savings. Further, during a one-year time frame that the present inventive method was used, approximately eight work days were lost, while in the years prior over 100 days were lost. Similar data was collected for an alternate manufacturing facility showing a significant reduction in medical and compensation costs along with a significant reduction in work days lost. In each case, workers were educated to the benefits of early care for low-back pain and instructed on the specific steps of the present invention.

While specific steps of the present invention have been described in detail hereinabove, it is to be understood that although certain steps have been identified, various modifications may be made from the specific details described herein without departing from the spirit and scope of the inventive steps as set forth in the appended claims.

Having now described the invention, including the advantageous new and useful results obtained thereby, the new and useful methods of use and reasonable equivalence thereof, obvious to those skilled in the art, are set forth in the appended claims.

What is claimed is:

1. A method for treating low-back pain in an injured person and restoring motion of the lumbar spine in flexion, the method comprising the steps of the injured person:

freely standing in an upright position on a surface with both legs straightened at the knees, arms hanging naturally by the sides;

providing a weight;

holding the weight below the waist in front of the legs;

bending forward at the waist while keeping knees straight;

continue bending at the waist to a flexed position while holding the weight wherein the arms are extended with hands reaching toward toes, the flexed position limited by a degree of pain and flexion of the injured person;

maintaining the flexed position for a predetermined time period;

slowly lifting the weight while rising to the freely standing position; and repeating the bending, maintaining and rising steps a multiplicity of times for restoring motion of the lumbar spine in flexion.

2. The method as recited in claim 1, wherein the weight comprises a bar and wherein the holding step comprises grasping the bar with palms down and hands separated by approximately a body width.

3. The method as recited in claim 1, further comprising the steps of:

stepping forward with one foot while holding the weight;

bending at the knees to the crouched position for lowering the weight onto the surface;

placing the weight onto the surface;

releasing the weight;

shifting the body weight over the feet;

standing upright to the standing position using leg muscles; and resting in the standing position.

4. The method as recited in claim 1, further comprising the steps of:

increasing a weight amount of the weight, the increased weight amount determined by a tolerance level for maneuvering the weight during the bending and rising steps; and repeating the bending and rising steps while holding the increased weight.

5. The method as recited in claim 4, further comprising the steps of:

reducing the weight amount, the reduced weight amount determined by the tolerance level for maneuvering the weight during the bending and rising steps; and repeating the bending and rising steps while holding the decreased weight.

6. The method as recited in claim 1, wherein the standing step is preceded by the steps of:

lying supine on the surface with legs bent in slight flexion at the knees;

pulling a first leg to a sufficiently close position proximate the chest while continuing to bend the corresponding first knee, the sufficiently close position determined by a tolerable lower back flexion pain level;

maintaining the first leg in the pulled position with its knee fully bent;

monitoring the tolerable pain level;

lowering the first leg to the surface while straightening the first knee;

returning the first leg to its slight flexion position;

pulling a second leg to the sufficiently close position proximate the chest while continuing to bend the corresponding second knee;

maintaining the second leg in the pulled position with the corresponding second knee fully bent;

monitoring the tolerable pain level;

lowering the second leg to the surface while straightening the second knee;

returning the second leg to its slight flexion position; and repeating the pulling, maintaining, lowering, returning and monitoring steps for the first and second legs while in the supine position until the tolerable pain level permits the upright standing step.

7. The method as recited in claim 1, wherein the standing step is preceded by the steps of:

lying supine on the surface with both legs bent in slight flexion at the knees;

straightening the first leg;

elevating the first leg by flexing at the hip;

monitoring the tolerable pain level;

lowering the first leg to the surface;

returning the first leg to the slight flexion position;

straightening the second leg;

elevating the second leg by flexing at the hip;

monitoring the tolerable pain level;

lowering the second leg to the surface;

returning the second leg to the slight flexion position; and repeating the straightening, elevating, lowering, returning and monitoring steps for both legs while in the supine position until the tolerable pain level permits the upright standing step.

8. The method as recited in claim 1, wherein the step of standing is preceded by the steps of:

sitting on the surface with body generally upright and fully extending legs in a generally straight position;

bending forward at the waist to a position of maximal stretch, the arms extending straight toward the toes while keeping the legs in th e straight position;

maintaining the forward bending position for a predetermined period of time; and slowly returning to the upright sitting position;

repeating the bending, maintaining and returning steps while in the sitting position until the tolerable pain level permits the upright standing step.

9. A method for treating low-back pain in an injured person and restoring body flexibility and full motion of the lumbar spine in flexion after a low back injury, the method comprising the steps of the injured person:

providing a weighted bar;

grasping the weighted bar with hands apart approximately body width;

freely standing in an upright position on a surface with both legs straightened at the knees, the feet separated sufficiently for balance during forward bending movements, the arms hanging naturally by the sides;

bending forward at the waist while keeping knees straight;

continue bending at the waist to a flexed position of maximal stretch wherein arms are extended in the direction of the toes, the maximal stretch limited by a degree of pain and flexion of the injured person;

maintaining the flexed position for a predetermined time period;

slowly rising to the standing position; and repeating the bending, maintaining and rising steps a multiplicity of times for restoring motion of the lumbar spine in flexion.

10. The method as recited in claim 9, wherein the flexed position of maximal stretch is selected from the group consisting of a first bending position with hands proximate the knees, a second bending position with hands proximate the shins, and a third bending position with hands proximate the ankles.

11. The method as recited in claim 9, further comprising the steps of:

placing the weighted bar on the surface proximate the feet;

facing the weighted bar;

stepping forward toward the bar with one foot, the forward stepping made from the upright standing position;

bending both knees and leaning forward in a crouched position;

grasping the bar with palms down, the bar lying on the surface within reach of the hands;

rolling the bar to a position above and proximate the forward feet;

lifting the bar while tightening your abdominal muscles;

rising to the forward stepping position while grasping the bar;

moving to the freely standing position with feet in a generally parallel position, the feet separated by a shoulders width;

holding the weight below the waist in front of the legs, the arms in a relaxed position wherein the bar rests proximate an upper leg portion below the waist; and proceeding with the bending forward at the waist step.

12. The method as recited in claim 11, further comprising the steps of:

stepping forward with one foot while holding the weighted bar;

bending at the knees to the crouched position for lowering the weighted bar onto the surface;

placing the weighted bar onto the surface;

releasing the weighted bar;

shifting your body weight over the feet;

standing upright to the freely standing position using leg muscles; and resting in the freely standing position.

13. The method as recited in claim 11, further comprising the steps of:

adding additional quantity of weight to the weighted bar, the added quantity of weight determined by a tolerance level for maneuvering the bar during the bending and rising steps; and repeating the bending and rising steps while holding the additionally weighted bar.

14. The method as recited in claim 13, wherein the step of adding additional quantity of weight to the weighted bar is selected from the group of adding ten pounds, adding twenty pounds, adding thirty pounds, and adding forty pounds.

15. The method as recited in claim 13, further comprising the steps of removing the additional quantity of weight for performing the bending and rising steps within the tolerance level and repeating the bending and rising steps while grasping the weighted bar having the reduced weight until the tolerance level permits the step of adding weight to the bar.

16. The method as recited in claim 9, wherein the standing step is preceded by the steps of:

lying supine on the surface with knees bent in slight flexion;

pulling a first knee to a position close to the chest with the arms while continuing leg flexing at the knee, the close position determined by an achievable lower back flexion;

maintaining the knee flexing position;

monitoring the tolerable pain level;

extending the first leg to the surface while straightening the first knee;

returning the first leg to its slight flexion position;

pulling a second knee to the close chest position;

maintaining the second knee in the pulled position;

monitoring the tolerable pain level;

lowering the second leg to the surface while straightening the second knee;

returning the second leg to its slight flexion position; and repeating the pulling, maintaining, lowering, returning and monitoring steps for the first and second legs while in the supine position until the tolerable pain level permits the upright standing step.

17. The method as recited in claim 9, wherein the standing step is preceded by the steps of:

lying supine on the surface with both legs bent in slight flexion at the knees;

straightening the first leg;

elevating the first leg by flexing at the hip;

using the arms to aid in the leg elevating step for holding the first leg in the hip flexing position for a predetermined time period;

monitoring the tolerable pain level;

lowering the first leg to the surface;

returning the first leg to the slight flexion position;

straightening the second leg;

elevating the second leg by flexing at the hip;

using the arms to aid in the leg elevating step for holding the second leg in the hip flexing position for the predetermined time period;

monitoring the tolerable pain level;

lowering the second leg to the surface;

returning the second leg to the slight flexion position; and repeating the straightening, elevating, lowering, returning and monitoring steps for both legs while in the supine position until the tolerable pain level permits the upright standing step.

18. The method as recited in claim 9, wherein the step of standing is preceded by the steps of:

sitting on the surface with body generally upright and fully extending legs in a generally straight position;

bending forward at the waist to a position of maximal stretch, the arms extending straight toward the toes while keeping the legs in the straight position;

maintaining the forward bending position for a predetermined period of time; and slowly returning to the upright sitting position;

repeating the bending, maintaining and returning steps while in the sitting position until the tolerable pain level permits the upright standing step.

19. A method for treating low back pain in an injured person by restoring motion to the lumbar spine in flexion, the method useful in on-site recovery of low back pain for increasing flexibility and returning motion to the lumbar spine, the method comprising the steps of the injured person:

supporting a weight from an upper body portion;

positioning the weight for lowering the weight toward the toes;

freely standing in an upright position on a surface with knees straight;

bending forward at the waist for flexing the lower spine to a maximal flexing position, the knees held straight, the maximal flexing position limited by a pain tolerance level and flexion of the injured person;

maintaining the flexed position while supporting the weight for a predetermined time period;

rising to the standing position; and repeating the bending, maintaining and rising steps a multiplicity of times for further extending the maximal position and restoring motion of the lumbar spine in flexion.

20. The method as recited in claim 19, further comprising the step of repeating the waist bending and rising steps with the weight for strengthening lower back muscles while restoring flexibility and motion to the lower back.

21. The method as recited in claim 19, further comprising the steps of:

supporting additional weight;

repeating the bending and rising steps while supporting the additional weight for further strengthening lower back muscles.

22. The method as recited in claim 19, wherein the step of standing is preceded by the steps of:

sitting on the surface with the legs extending in a generally straight position;

bending forward at the waist to a position of maximal stretch;

maintaining the forward bending position for a predetermined period of time; and slowly returning to the sitting position;

repeating the bending, maintaining and returning steps while in the sitting position until the standing step is achievable within a pain tolerance level.

23. The method as recited in claim 19, wherein the standing step is preceded by the steps of:

lying supine on the surface with legs bent in slight flexion at the knees;

pulling a first leg to a sufficiently close position proximate the chest while continuing to bend the corresponding first knee, the sufficiently close position determined by an achievable lower back flexion;

maintaining the first leg in the pulled position with its knee fully bent;

monitoring the tolerable pain level;

lowering the first leg to the surface while straightening the first knee;

returning the first leg to its slight flexion position;

pulling a second leg to the sufficiently close position proximate the chest while continuing to bend the corresponding second knee;

maintaining the second leg in the pulled position with the corresponding second knee fully bent;

monitoring the tolerable pain level;

lowering the second leg to the surface while straightening the second knee;

returning the second leg to its slight flexion position; and repeating the pulling, maintaining, lowering, returning and monitoring steps for the first and second legs while in the supine position until the standing step is achievable within a pain tolerance level.

24. The method as recited in claim 19, wherein the standing step is preceded by the steps of:

lying supine on the surface with both legs bent in slight flexion at the knees;

straightening the first leg;

elevating the first leg by flexing at the hip;

monitoring the tolerable pain level;

lowering the first leg to the surface;

returning the first leg to the slight flexion position;

straightening the second leg;

elevating the second leg by flexing at the hip;

monitoring the tolerable pain level;

lowering the second leg to the surface;

returning the second leg to the slight flexion position; and repeating the straightening, elevating, lowering, returning and monitoring steps for both legs while in the supine position until the standing step is achievable within a pain tolerance level.

25. A method for treating low back pain in an injured person by restoring motion to the lumbar spine in flexion, the method comprising the steps of the person:

freely standing in an upright position on a surface with knees straight;

bending forward at the waist for flexing the lower spine to a maximal flexing position, the knees held straight, the maximal flexing position limited by a pain tolerance level and flexion of the injured person;

maintaining the flexed position for a predetermined time period;

rising to the standing position;

repeating the bending, maintaining and rising steps a multiplicity of times for further extending the maximal position and restoring motion of the lumbar spine in flexion;

providing a weight;

supporting the weight from an upper body portion; while lowering the weight toward the toes during the waist bending steps;

bending forward at the waist while keeping knees straight;

continuing the waist bending step with the upper body weight, the bending limited by the pain tolerance and flexion of the injured person;

rising to the standing position; and repeating the waist bending and rising steps with the weight for strengthening lower back muscles while restoring flexibility and motion to the lower back.

26. The method as recited in claim 25, further comprising the steps of:

supporting additional weight;

repeating the bending and rising steps while supporting the additional weight for further strengthening lower back muscles.

27. A method for treating low back pain in an injured person by restoring motion to the lumbar spine in flexion, the method comprising the steps of the person:

initiating the motion-restoration method by first lying supine against a surface;

pulling a first leg to a sufficiently close position proximate the chest while bending the corresponding first knee, the sufficiently close position determined by an achievable lower back flexion and tolerance to pain;

maintaining the first leg in the pulled position with its knee fully bent;

monitoring the tolerance to pain;

lowering the first leg to the surface while straightening the first knee;

pulling a second leg to the sufficiently close position proximate the chest while bending the corresponding second knee;

maintaining the second leg in the pulled position with the corresponding second knee fully bent;

monitoring the tolerance to pain;

lowering the second leg to the surface while straightening the second knee;

repeating the pulling, maintaining, lowering, returning and monitoring steps for the first and second legs while in the supine position until a standing-step sequence is achievable within the pain tolerance level;

initiating the standing-step sequence by freely standing in an upright position on the surface with knees straight;

bending forward at the waist for flexing the lower spine to a maximal flexing position with the knees held straight, the maximal flexing position limited by a pain tolerance level and flexion of the injured person;

maintaining the flexed position for a predetermined time period;

rising to the standing position;

repeating the bending, maintaining and rising steps a multiplicity of times for further extending the maximal position and restoring motion of the lumbar spine in flexion;

providing a weight during at least a portion of the bending, maintaining and rising steps;

supporting the weight from an upper body portion while lowering the weight toward the toes during the waist bending steps;

bending forward at the waist while keeping knees straight;

continuing the waist bending step with the upper body weight, the bending limited by the pain tolerance and flexion of the injured person;

rising to the standing position; and repeating the waist bending and rising steps with the weight for strengthening lower back muscles while restoring flexibility and motion to the lower back.

28. A method for treating low back pain in an injured person by restoring motion to the lumbar spine in flexion, the method comprising the steps of the person:

lying supine on a surface with legs bent in slight flexion at the knees;

straightening the first leg;

elevating the first leg by flexing at the hip, the elevating limited by a pain tolerance level and flexion;

monitoring the pain tolerance level;

lowering the first leg to the surface;

returning the first leg to the slight flexion position;

straightening the second leg;

elevating the second leg by flexing at the hip, the elevating limiting the pain tolerance level and flexion;

monitoring the pain tolerance level;

lowering the second leg to the surface;

returning the second leg to the slight flexion position;

repeating the straightening, elevating, lowering, returning and monitoring steps for both legs while in the supine position until a standing step is achievable within the pain tolerance level;

freely standing in an upright position on the surface with knees straight;

bending forward at the waist for flexing the lower spine to a maximal flexing position, the knees held straight, the maximal flexing position limited by a pain tolerance level and flexion of the injured person;

maintaining the flexed position for a predetermined time period;

rising to the standing position;

repeating the bending, maintaining and rising steps a multiplicity of times for further extending the maximal position and restoring motion of the lumbar spine in flexion;

providing a weight;

supporting the weight from an upper body portion; while lowering the weight toward the toes during the waist bending steps;

bending forward at the waist while keeping knees straight;

continuing the waist bending step with the upper body weight, the bending limited by the pain tolerance and flexion of the injured person;

rising to the standing position; and repeating the waist bending and rising steps with the weight for strengthening lower back muscles while restoring flexibility and motion to the lower back.

* * * * *